US009936315B2

(12) United States Patent
Thomsen

(10) Patent No.: US 9,936,315 B2
(45) Date of Patent: Apr. 3, 2018

(54) METHOD OF FITTING A HEARING DEVICE TO A USER, A FITTING SYSTEM FOR A HEARING DEVICE AND A HEARING DEVICE

(71) Applicant: OTICON A/S, Smørum (DK)

(72) Inventor: Anders Højsgaard Thomsen, Smørum (DK)

(73) Assignee: OTICON A/S, Smørum (DK)

( * ) Notice: Subject to any disclaimer, the term of this patent is extended or adjusted under 35 U.S.C. 154(b) by 129 days.

(21) Appl. No.: 14/940,562

(22) Filed: Nov. 13, 2015

(65) Prior Publication Data

US 2016/0142838 A1 May 19, 2016

(30) Foreign Application Priority Data

Nov. 13, 2014 (EP) ..... 14193014

(51) Int. Cl.
*H04R 25/00* (2006.01)

(52) U.S. Cl.
CPC ..... *H04R 25/70* (2013.01); *H04R 25/505* (2013.01); *H04R 25/552* (2013.01);
(Continued)

(58) Field of Classification Search
CPC .. H04R 25/505; H04R 25/552; H04R 25/554; H04R 25/558; H04R 25/70;
(Continued)

(56) References Cited

U.S. PATENT DOCUMENTS 5,202,927 A * 4/1993 Topholm ..... H04R 25/558 381/312
5,434,924 A * 7/1995 Jampolsky ..... H04R 25/502 381/17

(Continued)

FOREIGN PATENT DOCUMENTS

EP 1453358 A2 9/2004
EP 1981309 A1 10/2008

(Continued)

*Primary Examiner* — Huyen D Le
(74) *Attorney, Agent, or Firm* — Birch, Stewart, Kolasch & Birch, LLP

(57) ABSTRACT

The application relates to a method of fitting a hearing device to a user, the method comprising a) Defining a user as a first time user; b) Selecting a processing algorithm to have special first time user settings; c) Defining prescribed settings for the user; d) Defining special first time user settings for said processing algorithm; e) Defining a scheme for adapting said special first time user settings to said prescribed settings over time. The application further relates to a method of a fitting system and to a hearing device. The object of the present application is to provide an alternative fitting scheme for a first time user of a hearing device. The method further provides that the processing algorithm to have special first time user settings is selected from the group comprising noise reduction algorithms, directionality algorithms, binaural compression algorithms, and a combination thereof. The method provides an alternative way of customizing a first time user of a hearing device to the usage of the hearing device. The invention may e.g. be used in hearing devices that need to be customized to a particular user's wishes.

20 Claims, 5 Drawing Sheets

(52) U.S. Cl.
CPC ..... *H04R 25/554* (2013.01); *H04R 2225/39* (2013.01); *H04R 2225/41* (2013.01); *H04R 2225/55* (2013.01)

(58) Field of Classification Search
CPC ..... H04R 2225/39; H04R 2225/41; H04R 2225/53; H04R 2225/55
USPC ..... 381/23.1, 60, 312, 314, 315, 320, 321, 381/313, 92, 94.1
See application file for complete search history.

(56) References Cited

U.S. PATENT DOCUMENTS

| | | | | |
|---|---|---|---|---|
| 2011/0249839 | A1 | 10/2011 | Mindlin et al. | |
| 2013/0223634 | A1* | 8/2013 | Rieger ..... | H04R 25/50 381/23.1 |

FOREIGN PATENT DOCUMENTS

| | | | |
|---|---|---|---|
| EP | 2375781 | A1 | 10/2011 |
| EP | 2635046 | A1 | 9/2013 |
| EP | 2701145 | A1 | 2/2014 |
| WO | WO 2014/094859 | A1 | 6/2014 |

* cited by examiner

METHOD OF FITTING A HEARING DEVICE TO A USER, A FITTING SYSTEM FOR A HEARING DEVICE AND A HEARING DEVICE

TECHNICAL FIELD

The present application relates to fitting of a hearing device, e.g. a hearing aid, to a user's needs. The disclosure relates specifically to a method of fitting a hearing device to a user.

The application furthermore relates to a fitting system for adapting a hearing device to a user's impairment. The application further relates to a data processing system comprising a processor and program code means for causing the processor to perform at least some of the steps of the method.

Embodiments of the disclosure may e.g. be useful in applications such as hearing devices that need to be customized to a particular user's wishes. The disclosure may e.g. be useful in applications such as hearing aids, headsets, ear phones, active ear protection systems, etc.

BACKGROUND

Clinical experience shows that newly-fit hearing-impaired persons often report that their devices are too powerful, especially in the higher frequencies. This result is not completely unexpected, because to the sensor in a neural-impaired ear, the increased audibility of softer, especially higher frequency sounds may be unsettling during the first few weeks of use. This newly audible information may be disturbing not only for first-time users, but also for experienced users accustomed to devices with less HF gain, or users who have worn only one instrument previously and now are being fitted with two.

Typically, a fitting system (an adaptation manager) for a hearing device, e.g. a hearing aid, is configured to allow first time users to adapt to the increased sound level (provided by the hearing device) by slowly turning up gain over time. So the first time user gets less gain (more compression) at the first fitting (than an experienced user with the same hearing loss profile) and will typically after an adaptation period, of e.g. 2-3 months use, get the prescribed gain as e.g. determined by a user's hearing profile (e.g. an audiogram) and a fitting algorithm (fitting rationale, e.g. NAL, DSL, etc.) translating hearing loss versus frequency to prescribed gain versus frequency for a specific hearing device.

The problem is that the rest of the hearing aid feature set (e.g. directionality and noise reduction, etc.) is not necessarily included in the 'first time user fitting strategy' of the fitting system. A cost of the lowering of gain (in particular of the lowering of gain at higher frequencies (e.g. above 2 kHz)) is that speech intelligibility is less than optimal.

SUMMARY

It is suggested by the present disclosure that instead of just applying less gain to a first time user, 'first time user settings' may be used for other algorithms (e.g. more directionality and more noise reduction) as an alternative or in addition to the gain reduction (or in a combination, e.g. using less gain reduction).

In the following, a differentiation between a first time user ($U_{1st}$) and an experienced user ($U_{exp}$) of a hearing device is made. Further, 'first time user settings' for a given processing algorithm are settings that are used for a first time user.

Prescribed settings' are correspondingly used for an experienced user. A first time user becomes an experienced user after the adaptation time. The 'first time user settings' and/or the 'prescribed settings' (or 'experienced user settings') for a particular user are typically forwarded to a hearing device intended to be used by the particular user from a programming device or a fitting system (e.g. a computer running fitting software) via a wired or wireless programming interface between the programming device and the hearing device. The 'first time user settings' and the 'prescribed settings' are determined with a view to 'hearing characteristics' of the particular user. The term 'hearing characteristics' of a particular user is in the present context taken to include data specifying the user's hearing loss (or threshold hearing level) as a function of frequency in the audible frequency range (or at least in the frequency range of operation of the hearing device). The term 'hearing characteristics' may additionally include data specifying the user's uncomfortable level as a function of frequency and possibly other data indicative of a user's hearing ability (e.g. level and/or frequency discrimination abilities).

An object of the present application is to provide an alternative fitting scheme for a first time user of a hearing device.

Objects of the application are achieved by the invention described in the accompanying claims and as described in the following.

A Method of Fitting a Hearing Device to a User:

In an aspect of the present application, an object of the application is achieved by a method of fitting a hearing device to a user, the hearing device comprising a forward path from an input to an output and number of processing algorithms applicable to a signal of the forward path, the signal of the forward path representing sound, the method comprising

- Defining a user as a first time user;
- Selecting a processing algorithm to have special first time user settings;
- Defining prescribed settings for the user of the selected processing algorithm;
- Defining special first time user settings for said processing algorithm;
- Defining a scheme for adapting said special first time user settings to said prescribed settings over time.

The method further comprises providing that said processing algorithm to have special first time user settings is selected from the group comprising noise reduction algorithms, directionality algorithms, binaural algorithms, and a combination thereof. In an embodiment, the binaural algorithm is a binaural compression algorithm or a binaural directionality algorithm or a binaural noise reduction algorithm or a combination thereof. In an embodiment, the method comprises providing that the processing algorithm to have special first time user settings is selected from the group consisting of noise reduction algorithms, directionality algorithms, binaural algorithms, and a combination thereof.

In the present context, a 'binaural algorithm' is an algorithm that takes into account parameter values of both hearing devices of a binaural hearing system (e.g. parameter values of corresponding algorithms applied in each hearing device).

The method provides an alternative way of a first time user of a hearing device to grow accustomed to the usage of the hearing device. The alternative procedure may e.g. help a first timer user to not focus on the noise and environment sounds not being a target signal (e.g. signals from the back).

Then over time (an 'adaptation time') the selected processing algorithm(s), e.g. directionality and/or noise reduction, may be adapted to the prescribed setting, e.g. over 2-3 months, from the first fitting of the hearing device to the final (prescribed) settings are applied.

In a typical fitting of a hearing device to an experienced user, a shift between an omni-directional mode (OMNI) of the microphone system to a directional mode (DIR) is (at least in a specific mode of operation of the hearing device, e.g. depending on the current acoustic environment) automatically performed at relatively low surrounding (noise) sound levels $L_{exp}$(OMNI→DIR). It is proposed to adapt the threshold $L_{1st}$(OMNI→DIR) for a first time user to a lower value than $L_{exp}$(OMNI→DIR). Thereby, the directional mode (DIR), where the microphone system focuses on a target signal, is entered at lower levels of the surrounding sounds to make the listening situation easier for the user (at the cost of surrounding sounds, assumed less important).

In a typical fitting of a hearing device to an experienced user, the application of a noise reduction scheme (e.g. an algorithm) and/or its 'aggressiveness' (degree of attenuation) is a function of a (target) signal (S) to (non-target signal) noise (N) ratio (S/N), e.g. so that noise reduction is less aggressive (attenuates less), the larger the (S/N). It is proposed to adapt the attenuation ATT for a given (S/N) to a higher value $ATT_{1st}$(S/N) for a first time user than the attenuation $ATT_{exp}$(S/N) typically set for an experienced user. Thereby, the noise reduction (NR) is more aggressive for the first time user (assumed noise components are attenuated more than for the experienced user) to provide more focus to the target signal (at the cost of surrounding sounds, assumed less important). The settings $ATT_{1st}$(S/N), $ATT_{exp}$(S/N) are typically frequency dependent.

The application of a noise reduction scheme may alternatively or additionally be dependent on the input level of sound $L_{IN}$, e.g. so that noise reduction is less aggressive (attenuates less) or is disabled for $L_{IN}<L_{IN}$(NR). It is proposed to lower the threshold level $L_{IN,1st}$(NR) for application of the noise reduction scheme for a first time user compared to a typical level $L_{IN,exp}$(NR) for an experienced user. Thereby, the noise reduction (NR) is more extensively put into use for the first time user in an attempt to make the listening situation easier for the user (at the cost of surrounding sounds, assumed less important).

It is proposed to gradually let the settings for the first time user converge towards the settings for the experienced user (i.e. towards the settings prescribed by the fitting system for the user in question, when treated as an experienced user). In an embodiment, the settings are modified in steps, e.g. a predetermined number of steps, e.g. 3 steps or more (such as 5 steps or more, such as 10 steps or more), over a predefined period of time, the adaptation period, e.g. 2 months or more, such as 3 months or more. The gradual modification of settings may be performed or initiated manually or automatically. In an embodiment, a predefined change of settings is performed by user activation via a user interface, e.g. via an activation element on the hearing device or via a remote control, e.g. via an APP of a SmartPhone (or the like). In an embodiment, a change of settings is made according to a predefined scheme implemented in the hearing device, by every power-on of the hearing device. In an embodiment, a change is made via the programming device (e.g. by an audiologist).

Other algorithms that may benefit from a special setting for a first time user is binaural compression dealing with situations (e.g. in a specific mode of operation) where current gains and/or input level estimates are exchanged between two hearing devices of a binaural hearing device system (cf. e.g. EP1981309A1) and used to coordinate the actual gains of each hearing device at a given point in time. An example of a different setting for a first time user could be to provide less binaural compression.

Spatial noise reduction algorithms, e.g. so-called better ear effect algorithms (see e.g. EP2375781A1), may also be candidates for a special setting for a first time user. In an embodiment, a more aggressive setting for a better ear effect algorithm is used for a first time user than for an experienced user. A more aggressive setting may e.g. imply using more attenuation at the poor SNR ear.

Likewise a transient noise reduction algorithm may also be a candidate for a special setting for a first time user. In an embodiment, a more aggressive setting for a transient noise reduction algorithm is used for a first time user than for an experienced user. A more aggressive setting may e.g. imply using more gain reduction (attenuation) at the transients to handle large (fast) changes ('transients') in the input signal.

The mentioned algorithms may be configured to have special first time user settings, which are (e.g. gradually) changed towards prescribed values over an initial adaptation time period. The initial adaptation time period may be the same for all algorithms selected for special treatment for first time users, or be individually determined (e.g. different for all or some of the algorithms). The initial adaptation time period may preferably be shorter for younger people (e.g. children) than for elderly people.

One or more of the mentioned algorithms may be selected in combination with prescribed gain settings (compression), or as an alternative. I.e. one or more of the mentioned algorithms may be configured to have special first time user settings instead of the gain setting (i.e. the gain setting has in such embodiment the prescribed setting from the beginning of a first time user's usage of the hearing device). Alternatively, a lower (than normal) gain reduction $\Delta G_{1st}$ (e.g. $\Delta G_{1st}<k\cdot\Delta G_{norm,1st}$, where k<1, e.g. equal to 0.5) for a first time user may be used together with the use of first time user settings for one or more selected processing algorithms.

A Fitting System:

In an aspect, a fitting system (or programming device) for adapting a hearing device to a user's impairment is furthermore provided by the present application. The fitting system comprises a programming interface to the hearing device, and is configured to execute the method as described above, in the 'detailed description of embodiments' or in the claims.

It is intended that some or all of the structural features of the method described above, in the 'detailed description of embodiments' or in the claims can be combined with embodiments of the system, when appropriately substituted by a corresponding structural feature and vice versa. Embodiments of the system have the same advantages as the corresponding method.

A Hearing Device:

In an aspect, a hearing device is furthermore provided. The hearing device comprises a forward path for processing an electric signal representing sound, the forward path comprises at least one input unit for providing an electric input signal representing sound, a configurable processing unit for applying one or more processing algorithms to an electric signal of the forward path, a compressor unit for applying a configurable level and/or frequency dependent gain according to a user's needs to an electric signal of the forward path, and an output unit for providing output stimuli perceivable as sound to a user based on an electric signal of the forward path. The hearing device further comprises a control unit for controlling processing parameters of said configurable processing unit and a programming interface allowing an exchange of data with a fitting system (programming device).

The term 'configurable' is in the present context taken to include that first time user gain settings can be applied and modified to prescribed gain settings over an adaptation time.

In an embodiment, the control unit is configured to control the adaptation of processing parameters for one or more processing algorithms of the processing unit. In an embodiment, the control unit is configured to control the adaptation of processing parameters for the configurable compressor unit. In an embodiment, the control unit is configured to control the adaptation of processing parameters for one or more processing algorithms of the configurable processing unit and/or the configurable compressor unit to implement a scheme for adapting special first time user settings to prescribed settings for said one or more processing algorithms over time (e.g. according to a predefined scheme).

In an embodiment, the control unit comprises a predefined scheme (e.g. an algorithm) for adapting processing parameters for the one or more processing algorithms of the preprocessing unit from special first time user settings to prescribed settings for the user over a time period.

In an embodiment, the hearing device comprises a user interface, e.g. one or more activation elements, e.g. buttons, and/or in the form of an interface to a remote control device for controlling functionality and operation of the hearing device (e.g. in the form of an APP for a smartphone or similar device). In an embodiment, the control unit is configured to allow a predefined change of settings (e.g. in steps) to be performed by user activation via the user interface. In an embodiment, the control unit is configured to allow a user to initiate a predefined change of settings via the user interface. In an embodiment, the control unit is configured to allow a user to reverse a previous change of settings via the user interface (e.g. a just initiated change, e.g. only the last change initiated via the user interface).

In an embodiment, the control unit is configured to control the adaptation of processing parameters for one or more processing algorithms of the preprocessing unit to have special first time user settings, wherein the one or more processing algorithms is/are selected from the group comprising (or consisting of) noise reduction algorithms, directionality algorithms, binaural algorithms, and a combination thereof. In an embodiment, the binaural algorithm is a binaural compression algorithm or a binaural directionality algorithm or a binaural noise reduction algorithm or a combination thereof.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the configurable processing unit is configured to enhance the input signals and provide a processed output signal.

In an embodiment, the hearing device comprises an output unit for providing a stimulus perceived by the user as an acoustic signal based on a processed electric signal. In an embodiment, the output unit comprises a number of electrodes of a cochlear implant type hearing device. In an embodiment, the output unit comprises an output transducer. In an embodiment, the output transducer comprises a receiver (loudspeaker) for providing the stimulus as an acoustic signal to the user.

In an embodiment, the output transducer comprises a vibrator for providing the stimulus as mechanical vibration of a skull bone to the user (e.g. in a bone-attached or bone-anchored hearing device).

In an embodiment, the hearing device comprises an input transducer for converting an input sound to an electric input signal. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the system (e.g. the hearing device or an auxiliary device) comprises one or more detectors, e.g. configured to provide signals relating to a current property of 'the physical environment' of the hearing assistance system, e.g. to provide parameters of the acoustic environment.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment.

In a particular embodiment, the hearing device comprises a voice activity detector (VAD) for determining whether or not an input signal comprises a voice signal (at a given point in time). This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice.

In a particular embodiment, the hearing device comprises a feedback detector (e.g. a tone detector in combination with a discriminator of whether a detected tone is due to feedback or not). In a particular embodiment, the hearing device comprises a detector of music, e.g. based on the feedback detector).

In an embodiment, the hearing device further comprises a noise reduction system, etc.

In an embodiment, the hearing device further comprises other relevant functionality for the application in question, e.g. compression, wireless connectivity, etc.

In an embodiment, the hearing device comprises a listening device, e.g. a hearing aid, e.g. a hearing instrument, e.g. a hearing instrument adapted for being located at the ear or fully or partially in the ear canal of a user or implanted in the head of a user, a headset, an earphone, an ear protection device or a combination thereof.

A Hearing System:

In an aspect, a hearing system is furthermore provided. The hearing system comprises a fitting system as described above, in the 'detailed description of embodiments', and in the claims, and a hearing device, wherein the hearing device comprises a programming interface allowing an exchange of date between the fitting system and the hearing device.

In an aspect, a hearing system comprising a fitting system as described above, in the 'detailed description of embodiments', and in the claims, and a hearing device as described above, in the 'detailed description of embodiments', and in the claims is furthermore provided.

In an embodiment, the hearing system further comprises an auxiliary device.

In an embodiment, the auxiliary device is or comprises a remote control for controlling functionality and operation of the hearing device(s). In an embodiment, the auxiliary device comprises a user interface for the hearing system, e.g. for the fitting system and/or for the hearing device(s).

In an embodiment, the auxiliary device is another hearing device. In an embodiment, the hearing system comprises two hearing devices adapted to implement a binaural hearing system, e.g. a binaural hearing aid system.

In an embodiment, the system is adapted to establish a communication link between the hearing device(s) and the fitting system and/or the auxiliary device to provide that information (e.g. control and status signals, possibly audio signals) can be exchanged or forwarded from one to the other, e.g. via the programming interface.

In an embodiment, the fitting system and/or the auxiliary device is or comprises a cellular telephone, e.g. a SmartPhone or a similar device. In an embodiment, the function of the fitting system and/or the user interface is implemented in a SmartPhone, the SmartPhone possibly running an APP. In an embodiment, the hearing device(s) and/or the fitting system comprises an appropriate wireless interface to the SmartPhone, e.g. based on Bluetooth or some other standardized or proprietary scheme.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Definitions:

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising one or two hearing devices and being adapted to cooperatively provide audible signals to both of the user's ears. Hearing systems or binaural hearing systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
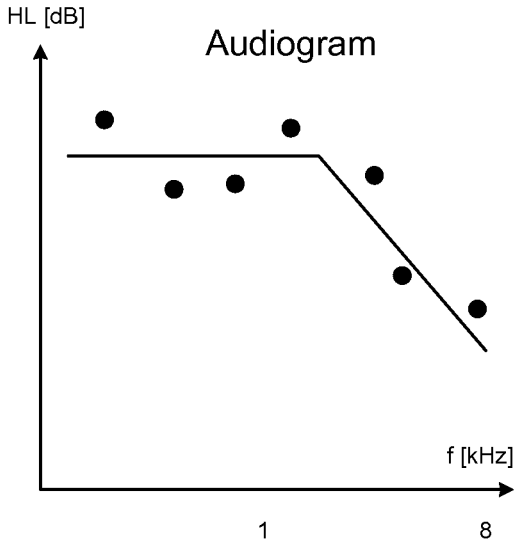
FIG. 1A schematically shows a frequency dependent hearing loss curve for a user, FIG. 1B schematically shows a consequent frequency dependent prescribed gain curve for an experienced hearing aid user (solid graph) and a $1^{st}$ time user (dashed graph), and FIG. 1C schematically shows a level compression curve for an experienced hearing aid user (solid) and a $1^{st}$ time user (dashed)

FIG. 1A schematically illustrates a hearing loss curve (an audiogram) of an ear of a hearing impaired user. The hearing loss of (an ear of) a user at a particular frequency is defined as the deviation in hearing threshold from the hearing threshold of a normally hearing person. Hearing loss is typically graphically illustrated in an audiogram, where a user's hearing loss (HL [dB]) has been measured at a number of frequencies (f [kHz], measured values schematically indicated by solid dots) over the frequency range of interest (typically below 8 kHz). In other words, an audiogram illustrates the deviation from normal hearing in that it graphically depicts the hearing threshold at the ear in question minus the hearing threshold of a normal hearing person (in dB).

Figure 1B:
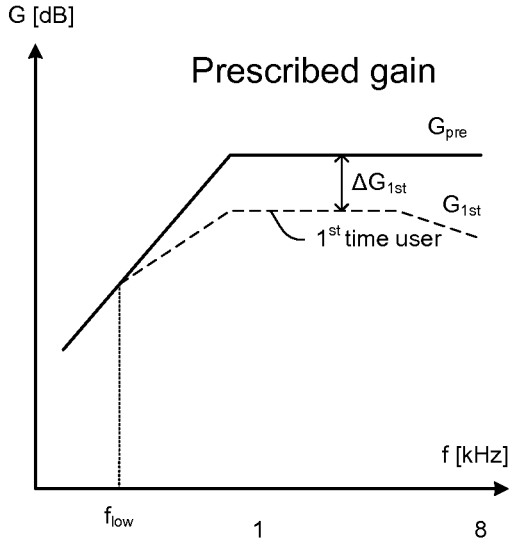

FIG. 1B schematically illustrates a frequency dependent (f, [kHz]), prescribed gain curve ($G_{pre}$ [dB], solid line) determined from the user's hearing profile (e.g. an audiogram, e.g. as in FIG. 1A) and a fitting algorithm (fitting rationale, e.g. NAL, DSL, etc.) translating hearing loss versus frequency to prescribed gain versus frequency (for a specific hearing device). In FIG. 1B, an exemplary gain ($G_{1st}$) versus frequency for a first time user ($1^{st}$ time user) is schematically shown (dashed line). The $1^{st}$ time user gain ($G_{1st}$) is reduced compared to the prescribed gain by an amount $\Delta G_{1st}$, e.g. a constant amount, e.g. 6 dB at all frequencies, or a frequency dependent amount $\Delta G_{1st}(f)$, e.g. only deviating from the prescribed gain above a certain frequency (termed $f_{low}$ in FIG. 1B, e.g. above 0-2 kHz). According to normal practice, the $1^{st}$ time user gain ($G_{1st}$) is changed towards the prescribed gain ($G_{pre}$) over a certain adaptation time $T_{adapt}$, e.g. 3 months, e.g. in a number of steps, e.g. 3 steps, e.g. with a predefined time between each step, e.g. 2 weeks or 1 month. In other words $\Delta G_{1st}(f,t) \rightarrow 0$, for $t \rightarrow T_{adapt}$ (or ($G_{1st} \rightarrow G_{pre}$, for $t \rightarrow T_{adapt}$).

Figure 1C:
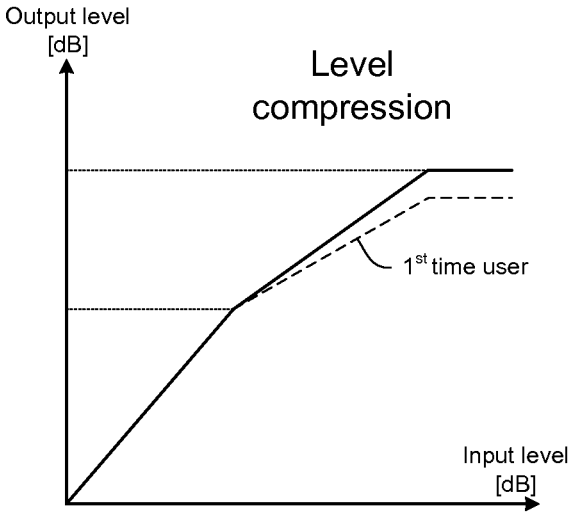

FIG. 1C schematically shows a compression curve. The compression ratio (i.e. the slope of an output level vs. input level curve) is adapted with a view to a user's hearing ability, e.g. the frequency dependent hearing threshold and comfort level curves of the user, e.g. during fitting procedure. In FIG. 1C, an exemplary compression curve for a first time user ($1^{st}$ time user) is schematically shown (dashed line).

Figure 2A:
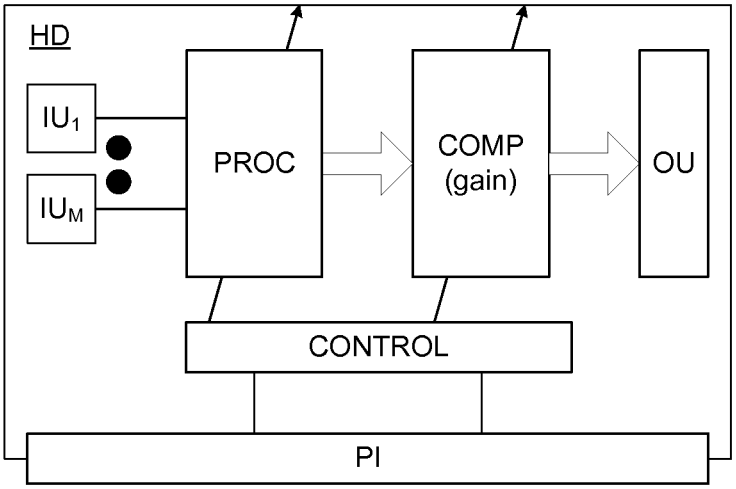
FIG. 2A shows a first embodiment of a hearing device according to the present disclosure.
Figure 2B:
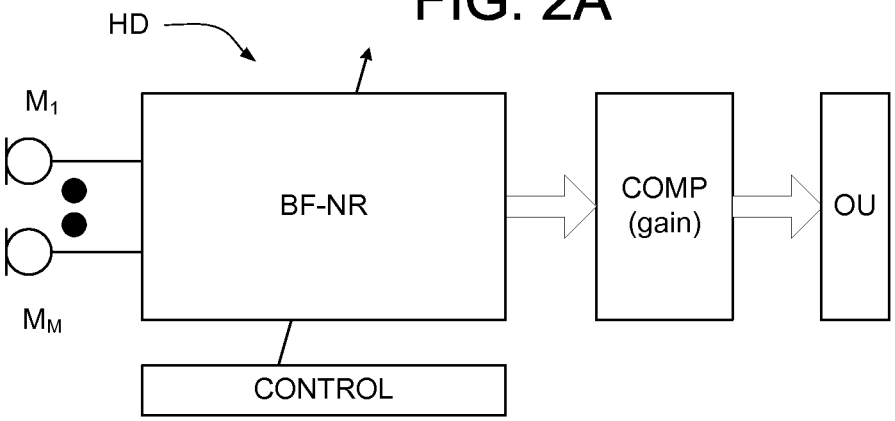
FIG. 2B shows a second embodiment of a hearing device according to the present disclosure.
Figure 2C:
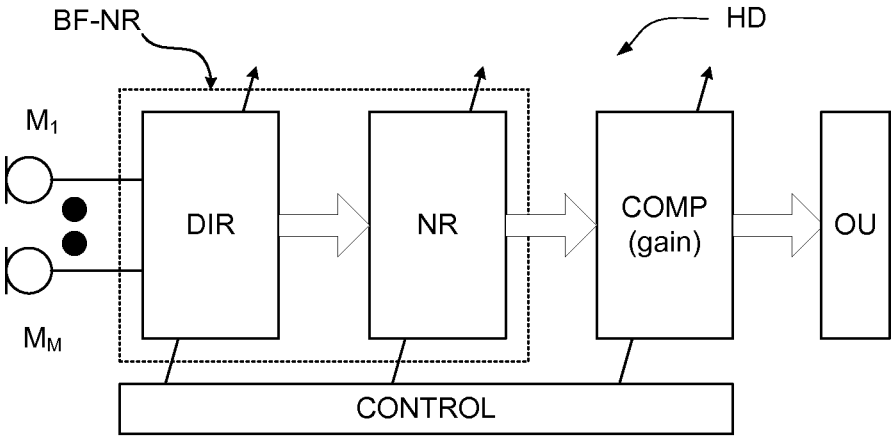
FIG. 2C shows a third embodiment of a hearing device according to the present disclosure.

FIGS. 2A, 2B, and 2C shows three embodiments of a hearing device according to the present disclosure.

The hearing device (HD) of FIG. 2A is configured to for enhance a signal representing sound according to a user's needs. The hearing device (HD) comprises a forward path for processing an electric signal representing sound. The forward path comprises at least one input unit (here M input units) $IU_1, \ldots, IU_M$, (each) for providing an electric input signal representing sound. The input units may e.g. be implemented as one or more microphones (e.g. a microphone array). The input units may alternatively comprise one or more transceiver units for receiving a direct electric signal comprising sound. The forward path further comprises a configurable processing unit (PROC) for applying one or more processing algorithms to an electric signal of the forward path and a configurable compressor unit (COMP) for applying a level and/or frequency dependent gain according to a user's needs to an electric signal of the forward path. The forward path further comprises one or more output units (OU) for providing output stimuli perceivable as sound to a user based on an electric signal of the forward path. The output unit (OU) may e.g. comprise one or more output transducers, e.g. a loudspeaker, a vibrator. The output unit (OU) may alternatively or additionally comprise a multi array electrode for electrically stimulating a cochlear nerve. The hearing device (HD) further comprises a control unit (CONTROL) for configuring processing parameters of the configurable processing unit (PROC) and (optionally) the configurable compressor unit (COMP). The configurable property of the control (CONTROL) and processing (PROC) units, respectively, is indicated by an arrow through the respective unit, the arrow being connected to the control unit indicating controllability from this unit. The hearing device (HD) further comprises a programming interface allowing an exchange of data with a fitting system (cf. e.g. FIGS. 3A, 3B, 3C). The control unit (CONTROL) is configured to control the adaptation of processing parameters for one or more processing algorithms of the configurable processing unit (PROC) and/or of the configurable compressor unit (COMP) to implement a scheme for adapting special first time user settings (of the one or more processing algorithms) to prescribed settings for the one or more processing algorithms over time.

The embodiments of FIGS. 2B and 2C comprise the same functional units (including the programming interface, not shown) as the embodiment of FIG. 2A.

In the embodiment of FIG. 2B, the input units $IU_1, \ldots, IU_M$, are embodied as microphone units $M_1, \ldots, M_M$, e.g. 2 or more microphone units (M=2 or more). The configurable processing unit (PROC) for applying one or more processing algorithms to an electric signal of the forward path is in FIG. 2B embodied in a combined directionality and noise reduction unit, her termed a beam-former-noise reduction system (BF-NR) which is controllable from the control unit (CONTROL), e.g. by a fitting system (via a programming interface) or by a predefined scheme implemented in the hearing device (e.g. the control unit). The compressor unit (COMP) is shown NOT to be configurable ('configurable' in the sense that first time user gain settings are applied and modified to prescribed gain settings over an adaptation time).

The embodiment of a hearing device (HD) in FIG. 2C is equivalent to the embodiment of FIG. 2B, in that it comprises the same functional units. A difference is that apart from the compressor unit (COMP) is configurable. Further, the beam-former-noise reduction system (BF-NR) is shown to comprise a separate directional unit (DIR) (or beamformer) and a (e.g. single channel) noise reduction system (NR) and that processing parameters of these units are individually controllable from the control unit (CONTROL). The beam-former-noise reduction system (BF-NR) may be implemented in many different ways as is customary in the art, e.g. as a Minimum Variance Distortionless Response (MVDR) beam former and a single-channel post-filter (see e.g. EP2701145A1).

Figure 3A:
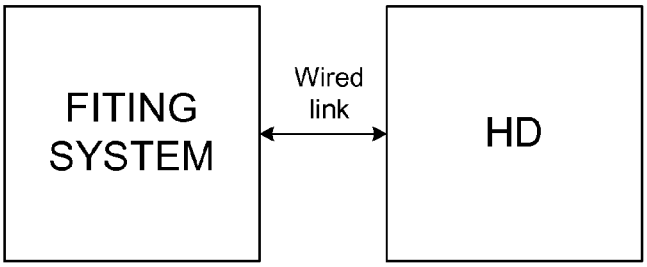
FIG. 3A shows a first embodiment of a hearing system according to the present disclosure.
Figure 3B:
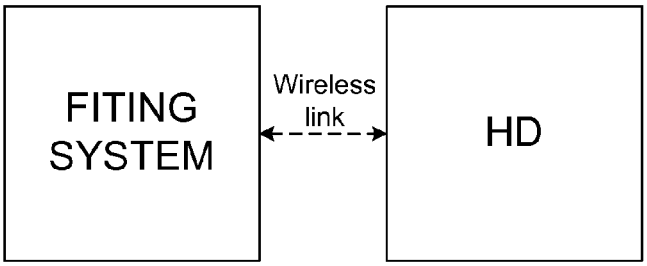
FIG. 3B shows a second embodiment of a hearing system according to the present disclosure.
Figure 3C:
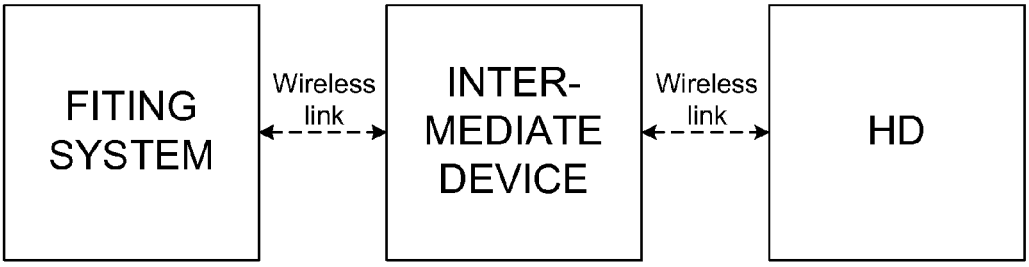
FIG. 3C shows a third embodiment of a hearing system according to the present disclosure.

FIGS. 3A, 3B, and 3C shows three embodiments of a hearing system according to the present disclosure.

FIG. 3A shows a fitting system (FITTING SYSTEM) operationally coupled to a hearing device (HD), either by a wired communication link (Wired link, FIG. 3A) or by a wireless communication link (Wireless link, FIG. 3B). FIG. 3C shows an embodiment of a hearing system comprising a fitting system (FITTING SYSTEM) operationally coupled to a hearing device (HD) via an intermediate device (INTERMEDIATE DEVICE) and respective wireless links (Wireless link). The intermediate device may e.g. implement a user interface (e.g. comprising a graphical user interface) for the fitting system and/or the hearing device. The intermediate device may e.g. be implemented in a SmartPhone or similar handheld device (inherently) comprising a user interface. The fitting system is configured to allow a user of the hearing device (HD) to be defined as a first time user, to select one or more processing algorithms to have special first time user settings, to define prescribed settings for the user of the selected processing algorithm and to define special first time user settings for the selected processing algorithm(s). Preferably, the fitting system is configured to allow the definition of a scheme for adapting the special first time user settings to the prescribed settings over an adaptation time. The fitting system is configured to allow the transfer of parameter settings for processing algorithms of the hearing device from the fitting system to (appropriate processing units of) the hearing device.

Figure 4:
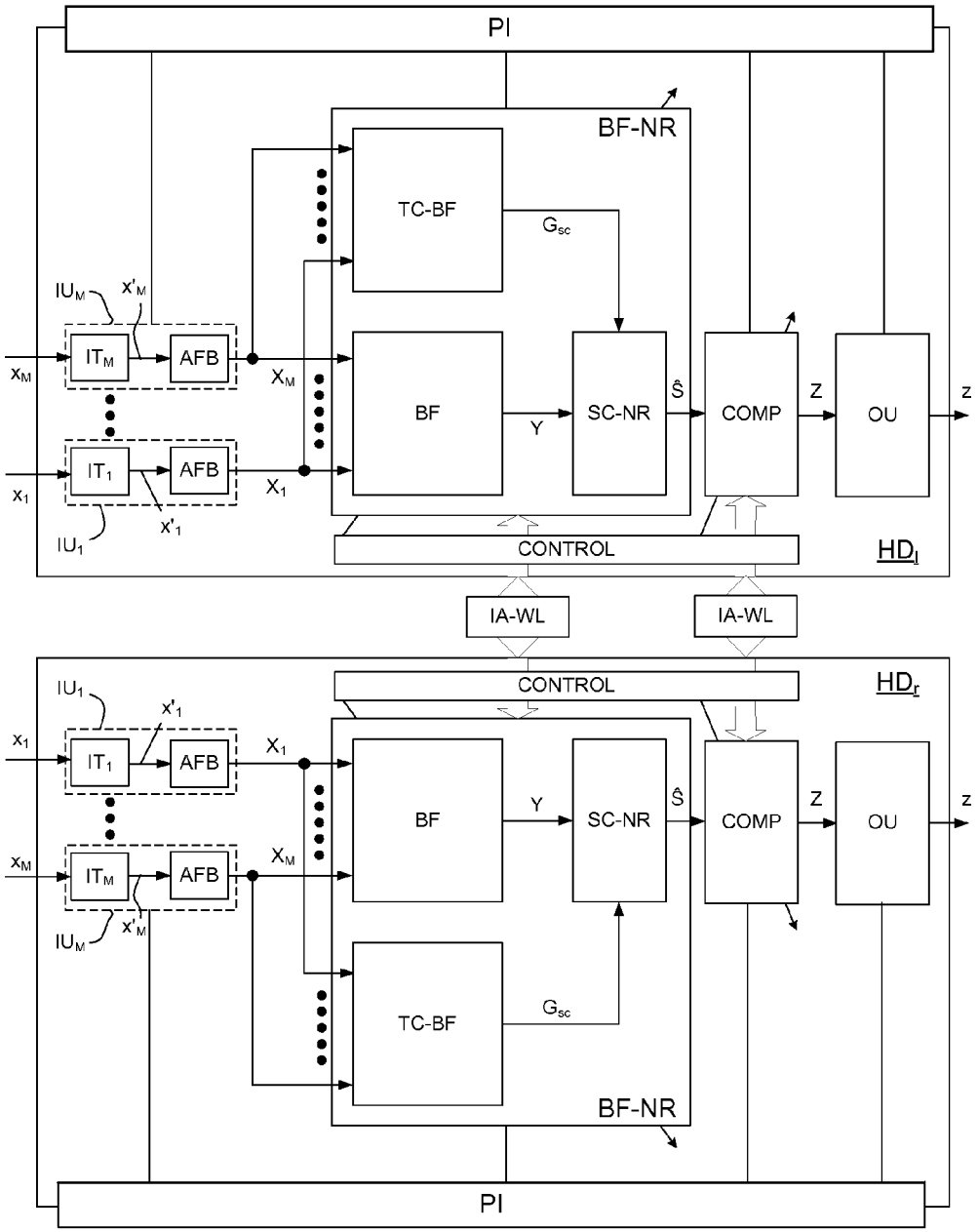
FIG. 4 shows an embodiment of a binaural hearing system according to the present disclosure.

FIG. 4 shows an embodiment of a binaural hearing system according to the present disclosure. The binaural hearing system comprises two (e.g. substantially identical) hearing devices $HD_l$ and $HD_r$ adapted for being located at or in (or fully or partially implanted in the head near cochlea of) the left and right ears of a user. The left and right hearing devices comprises the same units as discussed in connection with FIGS. 2A, 2B, 2C, i.e. an input unit (IU), a beamforming and a noise reduction system (BF-NR), a compression unit (COMP), an output unit (OU), and a control unit (CONTROL), the BF-NR- and COMP-units being in operational connection with the CONTROL unit.

In FIG. 4, each of the left ($HD_l$) and right ($HD_r$) hearing devices comprises a multitude of input units $IU_i$, i=1, . . . , M, M being larger than or equal to two. Each of the input units ($IU_i$) comprises an input transducer ($IT_i$), e.g. a microphone, providing an electric input signal $x'_i(n)$ and an analysis filter bank (AFB) providing a time-frequency representation $X_i(k,m)$ of a time variant input sound signal $x_i(n)$ ($i=1, 2, \ldots, M_1$) at an $i^{th}$ input unit in a number of frequency bands and a number of time instances, k being a frequency band index, m being a time index, n representing time. The number of input units of each of the left and right hearing devices is assumed to be M. Alternatively, the number of input units of the two devices may be different.

Each of the left ($HD_l$) and right ($HD_r$) hearing devices comprises a multi-input unit noise reduction system (BF-NR) a beamformer (BF), a target-cancelling beamformer (TC-BF), and a single channel noise reduction unit (SC-NR). The multi-channel beamformer filtering unit (BF) and the target cancelling beam-former unit (TC-BF) are operationally coupled to the multitude of input units $IU_i$, i=1, . . . , M, (signals $X_1, \ldots, X_M$) and configured to provide a (resulting) beamformed signal Y, wherein signal components from other directions than a direction of a target signal source are attenuated, whereas signal components from the direction of the target signal source are left un-attenuated or attenuated less than signal components from said other directions. The beamformer may comprise minimum variance distortionless response (MVDR) beamformers or, more generally, linearly constrained minimum variance (LCMV) beamformers.

The single-channel post-processing filter unit (SC-NR) is operationally coupled to the multi-channel beamformer filtering unit (BF) and configured to provide an enhanced signal $\hat{S}$ (k,m). A purpose of the single-channel post-processing filter unit (SC-NR) is to suppress noise components from the target direction, which have not been suppressed by the multi-channel beamformer filtering unit (BF). A task of the single-channel post-processing filter unit (SC-NR) is to suppress noise components during time periods, where the target signal is present or dominant (as e.g. determined by a voice activity detector, VAD) as well as when the target signal is absent.

The multi-input unit noise reduction system (BF-NR) comprises a target-cancelling beamformer (TC-BF), receiving inputs signals $X_1, \ldots, X_M$ and provides gains $G_{sc}$ to be applied to respective time-frequency units of the beamformed signal Y in the respective single-channel post-processing filter units (SC-NR).

The embodiment of FIG. 4 further provides an optional exchange of (one or more) data related to the multi-input unit noise reduction system (BF-NR) between the two hearing devices, as indicated by the arrow (IA-WL, indicating presence of an interaural wireless link) between the left ($HD_l$) and right ($HD_r$) hearing devices. Preferably, the estimate of the target signal to noise ratio for each time-frequency tile (m,k) of the resulting signal $\hat{S}$ is determined from the beamformed signal Y and the target-cancelled signal (cf. gains $G_{sc}$ in FIG. 4). If the single-channel post-processing filter units SC-NRs operate independently and uncoordinated, they may distort the interaural cues of the target component, which may lead to distortions in the perceived location of the target source. To avoid this, the SC-NR systems may exchange their estimates of their (time-frequency dependent) gain values and decide on using the same, for example the largest of the two gain values for a particular time-frequency unit, whereby a binaural noise reduction scheme is implemented. In this way, the suppression applied to a certain time-frequency unit is the same in the two ears, and no artificial inter-aural level differences are introduced. The binaural noise reduction scheme may e.g. be differently implemented for a first time user than for an experienced user. In an embodiment, the first time user settings of the binaural noise reduction system may be less aggressive then for an experienced user.

The output $\hat{S}$ of the multi-input unit noise reduction system (BF-NR) is fed to the compression unit (COMP), where a user specific level and frequency dependent gain is applied to the signal and an output signal Z is provided and fed to the output unit (OU), e.g. one or more loudspeakers. An exchange of gains and/or level estimates for the respective compression units (COMP) is also indicated in FIG. 4 via an interaural wireless link (IA-WL), e.g. an inductive link. Thereby a binaural compression scheme can be implemented. Binaural compression may e.g. involve a harmonization of the compression values between the left ($HD_l$) and right ($HD_r$) hearing devices, e.g. to provide that input signals to the left and right hearing devices are attenuated with substantially the same amount (to keep any localization cues that are due to head and body shadowing effects (interaural level differences, ILD). A binaural compression algorithm may e.g. be differently implemented for a first time user than for an experienced user. In an embodiment, the first time user settings of the binaural compression system may be to provide less binaural compression (e.g. to limit the gain change imposed from 'the contra-lateral hearing device' during the adaptation period from a first time fitting, e.g. to a specific amount per step, e.g. 2 dB/step).

Each of the left and right hearing devices of the binaural hearing system of FIG. 4 further comprises a programming interface (PI) allowing an exchange of data between the hearing devices and a fitting system (as indicated by connections from the programming interface (PI) to one or more of functional blocks input units ($IU_i$, i=1, . . . , M), multi-input unit noise reduction system (BF-NR), compression unit (COMP), and output unit (OU).

The binaural hearing system may further comprise a user interface configured to communicate with the left and right hearing devices and/or a fitting system, thereby allowing a user to influence functionality of the system and the left and right hearing devices.

Figure 5:
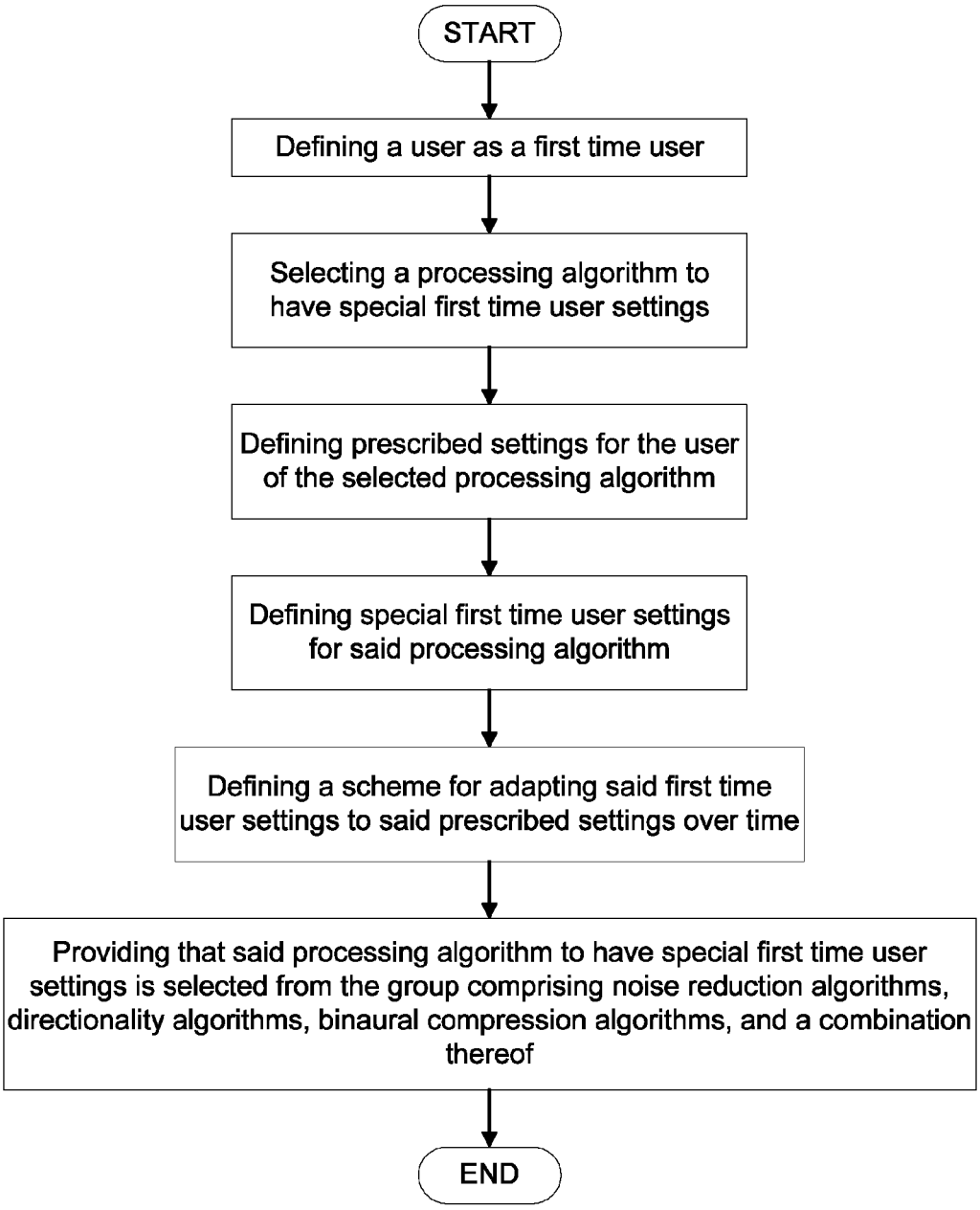
FIG. 5 shows a flow diagram of an embodiment of a method of fitting a hearing device according to the present disclosure.

FIG. 5 shows a flow diagram of an embodiment of a method of fitting a hearing device according to the present disclosure. The method comprises the following steps:

- Defining a user as a first time user;
- Selecting a processing algorithm to have special first time user settings;
- Defining prescribed settings for the user of the selected processing algorithm;
- Defining special first time user settings for said processing algorithm;
- Defining a scheme for adapting said first time user settings to said prescribed settings over time;
- Providing that the processing algorithm to have special first time user settings is selected from the group comprising (e.g. consisting of) noise reduction algorithms, directionality algorithms, binaural compression algorithms, and a combination thereof.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein.

Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2701145A1 (RETUNE, OTICON) Feb. 26, 2014
EP1981309A1 (OTICON) Oct. 15, 2008
EP2375781A1 (OTICON) Oct. 12, 2011

The invention claimed is:

1. A method of fitting a hearing device to a user, the hearing device comprising a forward path from an input to an output and number of processing algorithms applicable to a signal of the forward path, the signal of the forward path representing sound, the method comprising defining a user as a first time user;

selecting a processing algorithm from the group consisting of noise reduction algorithms, directionality algorithms, binaural algorithms, and a combination thereof to have special first time user settings;

defining prescribed settings for the user of the selected processing algorithm;

defining special first time user settings for said processing algorithm;

defining a scheme for adapting said special first time user settings to said prescribed settings over time.

2. A method according to claim 1 wherein the selected processing algorithm is a directionality algorithm and wherein a shift between an omni-directional mode (OMNI) to a directional mode (DIR) is automatically performed at a predefined threshold level L(OMNI→DIR) of a signal of the forward path, and wherein the threshold level $L_{1st}$(OMNI→DIR) for a first time user is lower than the prescribed threshold level $L_{exp}$(OMNI→DIR).

3. A method according to claim 1 wherein the selected processing algorithm is a noise reduction algorithm for reducing noise components in a signal of the forward path and wherein attenuation ATT provided by the noise reduction algorithm is smaller, the larger a signal to noise ratio (S/N) of the signal of the forward path, and wherein the attenuation $ATT_{1st}$(S/N) for a first time user is higher than the prescribed attenuation $ATT_{exp}$(S/N), at least at some frequencies.

4. A method according to claim 1 wherein the selected processing algorithm is a noise reduction algorithm for reducing noise components in a signal of the forward path and wherein attenuation ATT provided by the noise reduction algorithm is dependent on an input level of sound $L_{IN}$, so that attenuation ATT provided by the noise reduction algorithm is smaller or zero below a predefined threshold value $L_{IN,NR-TH}$ of the input level $L_{IN}$, and wherein the threshold level $L_{IN,NR-TH,1st}$ for a first time user is smaller than the prescribed threshold values $L_{IN,exp}$(NR), at least at some frequencies.

5. A method according to claim 1 wherein the selected processing algorithm is a binaural compression algorithm for coordinating the gain settings of a compression algorithm in first and second hearing devices of a binaural hearing device system at a given point in time.

6. A method according to claim 1 wherein the selected processing algorithm is a spatial noise reduction algorithm or a transient noise reduction algorithm.

7. A method according to claim 1 wherein the settings for the first time user converge towards the prescribed settings for a selected processing algorithm over an adaptation time.

8. A method according to claim 7 wherein the settings for the first time user are modified automatically according to a predefined scheme.

9. A method according to claim 1 wherein special first time user settings for the selected processing algorithm(s) is/are used in combination or as an alternative to special first time user settings of the gains of a compression algorithm.

10. A method according to claim 9 wherein gain reductions of special first time user settings of the compression algorithm are lower than normal gain reductions for a first time user, when used together with special first time user settings for one or more selected processing algorithms.

11. A fitting system for adapting a hearing device to a user's impairment, the fitting system comprising:

a programming interface to the hearing device, and is wherein the hearing device comprises a forward path from an input to an output and number of processing algorithms applicable to a signal of the forward path, the signal of the forward path representing sound, and the programming interface is configured to select a processing algorithm from the group consisting of noise reduction algorithms, directionality algorithms, binaural algorithms, and a combination thereof to have special first time user settings;

define prescribed settings for the user of the selected processing algorithm;

define special first time user settings for said processing algorithm;

define a scheme for adapting said special first time user settings to said prescribed settings over time.

12. A hearing device for enhancing a signal representing sound according to a user's needs, the hearing device comprising a forward path for processing an electric signal representing sound, the forward path comprises at least one input unit for providing an electric input signal representing sound, a configurable processing unit for applying one or more processing algorithms to an electric signal of the forward path, a configurable compressor unit for applying a level and/or frequency dependent gain according to the user's needs to an electric signal of the forward path, and an output unit for providing output stimuli perceivable as sound to ache user based on an electric signal of the forward path, wherein the hearing device further comprises a control unit for configuring processing parameters of said configurable processing unit and a programming interface allowing an exchange of data with a fitting system, wherein the control unit is configured to control the adaptation of processing parameters for one or more processing algorithms of the configurable processing unit to implement a scheme for adapting special first time user settings to prescribed settings for said one or more processing algorithms over time, and wherein said one or more processing algorithms is/are selected from the group consisting of noise reduction algorithms, directionality algorithms, binaural algorithms, and a combination thereof.

13. A hearing device according to claim 12 comprising a hearing aid or hearing instrument adapted for being located at the ear or fully or partially in the ear canal of the user or implanted in the head of a user, or a combination thereof.

14. A hearing device according to claim 12 comprising a user interface allowing the user to initiate a predefined change of settings via the user interface.

15. A hearing device according to claim 14 wherein the control unit is configured to allow the user to reverse a previous change of settings via the user interface.

16. A hearing device according to claim 12 wherein the binaural algorithm is a binaural compression algorithm or a binaural directionality algorithm or a binaural noise reduction algorithm or a combination thereof.

17. A hearing device according to claim 12 wherein the control unit is configured to apply a predefined scheme for adapting processing parameters for the one or more processing algorithms of the preprocessing unit from special first time user settings to prescribed settings for the user over a time period.

18. A hearing system comprising a fitting system and a hearing device according to claim 12, wherein the fitting system comprises a programming interface allowing an exchange of data between the fitting system and the hearing device.

19. A hearing system comprising:

a fitting system; and a hearing device comprising a programming interface allowing an exchange of data between the fitting system and the hearing device and a forward path from an input to an output and number of processing algorithms applicable to a signal of the forward path, the signal of the forward path representing sound, wherein the fitting system comprises a programming interface is configured to select a processing algorithm from the group consisting of noise reduction algorithms, directionality algorithms, binaural algorithms, and a combination thereof to have special first time user settings;

define prescribed settings for the user of the selected processing algorithm;

define special first time user settings for said processing algorithm;

define a scheme for adapting said special first time user settings to said prescribed settings over time.

20. A data processing system comprising:

a processor; and a memory having stored therein program code that when executed by the processor causes the processor to fit a hearing device to a user, the hearing device comprising a forward path from an input to an output and number of processing algorithms applicable to a signal of the forward path, the signal of the forward path representing sound, by selecting a processing algorithm from the group consisting of noise reduction algorithms, directionality algorithms, binaural algorithms, and a combination thereof to have special first time user settings;

defining prescribed settings for the user of the selected processing algorithm;

defining special first time user settings for said processing algorithm;

defining a scheme for adapting said special first time user settings to said prescribed settings over time.

* * * * *